US011213155B1

(12) United States Patent
Edinger

(10) Patent No.: US 11,213,155 B1
(45) Date of Patent: Jan. 4, 2022

(54) MAILBOX WITH TELESCOPING DRAWER

(71) Applicant: James J. Edinger, Stevensville, MT (US)

(72) Inventor: James J. Edinger, Stevensville, MT (US)

( * ) Notice: Subject to any disclaimer, the term of this patent is extended or adjusted under 35 U.S.C. 154(b) by 0 days.

(21) Appl. No.: 17/017,496

(22) Filed: Sep. 10, 2020

(51) Int. Cl.
*A47G 29/12* (2006.01)

(52) U.S. Cl.
CPC ... *A47G 29/1209* (2013.01); *A47G 29/12097* (2017.08)

(58) Field of Classification Search
CPC ..... A47G 29/1209; A47G 29/12097; A47G 29/122
USPC ..... 232/17, 29, 33, 38
See application file for complete search history.

(56) References Cited

U.S. PATENT DOCUMENTS 838,194 A 12/1906 Larsh
908,543 A 1/1909 Brown
1,848,995 A * 3/1932 Coleman ..... A47G 29/121 232/33
2,760,721 A 4/1956 Roberts
2,868,444 A 1/1959 Whittier
3,606,140 A * 9/1971 Shannahan ..... A47G 29/12097 232/17
4,714,192 A * 12/1987 Harlow, Jr. ..... A47G 29/1216 211/126.15
4,896,827 A * 1/1990 Economou ..... A47G 29/1209 232/17
4,934,592 A 6/1990 DiMenichi
5,271,555 A 12/1993 Mayer
5,425,501 A 6/1995 Wesorick
5,775,578 A * 7/1998 Baxi ..... A47G 29/12097 232/17
5,954,264 A * 9/1999 Keller ..... A47G 29/1212 232/17
6,698,651 B1 3/2004 Green
6,997,373 B2 2/2006 Flores
7,004,380 B2 2/2006 Gunvaldson
7,210,616 B1 * 5/2007 Van Watermulen ..... A47G 29/12097 232/29
7,938,314 B1 * 5/2011 Benesh ..... A47G 29/1214 232/45
8,042,729 B2 10/2011 Dinh
8,657,185 B2 2/2014 Corey
2004/0211827 A1 * 10/2004 Gunvaldson ..... A47G 29/12097 232/19

(Continued)

*Primary Examiner* — William L Miller
(74) *Attorney, Agent, or Firm* — Antoinette M. Tease

(57) ABSTRACT

A mailbox with a housing, a floor and a receptacle situated on top of a sliding rail assembly affixed to the floor. A first bracket is affixed to the inside surface of the door and connected to a first U-shaped bracket with a downwardly facing open part. The two legs of the first U-shaped bracket are pivotally attached to longitudinal rods extending underneath the mailbox. The distal end of each longitudinal rod is pivotally attached to a second U-shaped bracket with a downwardly facing open part. A first end of a traveling rod extends upwardly from the lateral part of the second U-shaped bracket, and a second end of the traveling rod is attached to a shaft. A wheel bearing is situated on either end of the shaft, and a receiving bracket is attached to the rear wall of the receptacle and configured to receive the wheel bearings and shaft.

4 Claims, 14 Drawing Sheets

(56) References Cited

U.S. PATENT DOCUMENTS

| | | | | |
|---|---|---|---|---|
| 2005/0247770 | A1* | 11/2005 | Priest | A47G 29/12097 232/20 |
| 2005/0258227 | A1 | 11/2005 | Flores | |
| 2011/0210166 | A1 | 9/2011 | Dinh | |
| 2013/0020384 | A1 | 1/2013 | Corey | |

* cited by examiner

MAILBOX WITH TELESCOPING DRAWER

BACKGROUND OF THE INVENTION

1. Field of the Invention

The present invention relates generally to the field of mailboxes, and more particularly, to a mailbox with a telescoping drawer that facilitates retrieval of items from the mailbox.

2. Description of the Related Art

Conventional mailboxes require an individual to extend his or her arm into the mailbox in order to retrieve mail or packages situated within the main compartment of the mailbox. The very back of the mailbox is not often visible, which means that an individual may be required to extend his or her arm into the mailbox without being able to see what may be in there. People are often exposed to dirt and debris (making work clothes dirty) or insects, bird excrement, etc. when retrieving their mail. In addition, it is not always possible to reach all the way into the mailbox from the seat of a car. Various mailbox innovations are discussed below.

U.S. Patent No. 838194 (Larsh, 1906) discloses a mailbox with an automatically sliding receptacle that brings the mail in the mailbox forward to permit easy retrieval. The mailbox is also configured so that when the receptacle slides forward, the mailbox door provides a roof or ceiling over the mail in the drawer to prevent it from exposure to the elements. The mailbox door and the sliding receptacle are mechanically connected with bars.

U.S. Pat. No. 908,543 (Brown, 1909) provides a mailbox with a signal (or flag) pivotally attached to the front door and a tray with outer extensions that run upon guides provided along the inner sides of the vertical walls of the box. Arms pivotally connect the front door of the mailbox to the sides of the tray. The outer front edge of the mailbox includes a notch into which the stem of the signal may be inserted to signify that there are items in the mailbox.

U.S. Pat. No. 2,760,721 (Roberts, 1954) discloses a mailbox letter rack comprising a relatively narrow trough-shaped letter receptacle that is situated within the mailbox. One end of the rack is connected to the mailbox by swinging link means, and the other end of the rack is connected to the mailbox door by pivot means. The rack is situated entirely within the mailbox when the door is closed and is drawn partly out of the box when the door is opened.

U.S. Pat. No. 2,868,444 (Whittier, 1958) provides a mail box accessory in the form of a drawer-type mail receptacle that is movably installed within a conventional mailbox. The receptacle is adapted to be withdrawn like a drawer through the open end of the box to expose the major portion of the receptacle in a downwardly inclined position for the removal of mail. A stop means on the outer lateral side of the receptable is engageable with an inturned edge of the mailbox opening to limit withdrawal of the receptacle as the user pulls it outwardly to deposit mail in or retrieve mail from the receptacle. A second stop means on the bottom of the receptacle rests against the bottom of the mailbox when the receptacle is withdrawn and supports the receptacle within its inner end at a slightly higher elevation than its forward end.

U.S. Pat. No. 4,934,592 (DiMenichi, 1990) discloses a receptable for a mailbox in which a container is positioned within the mailbox and supported by a leaf spring. One end of the leaf spring is connected to the mailbox door so that when the mailbox door is opened, the container is moved outwardly from the mailbox to expose the items in the container. The receptacle is supported by the leaf spring in a cantilevered manner so that the receptable is oriented in an inclined position (with the front end of the receptacle on a higher elevation than the rear end) within the mailbox when the door is closed.

U.S. Pat. No. 5,721,555 (Mayer, 1993) provides a movable mailbox tray in the form of a trolley that rides on a plurality of rollers situated between the tray floor and the lower housing panel. A spring that connects the tray floor to the mailbox door, thereby causing the tray to roll out when the mailbox is opened. The movable tray is also connected to the rear vertical wall of the mailbox by a second spring that pulls the trolley back into the interior of the mailbox when the door is closed.

U.S. Pat. No. 5,425,501 (Wesorick, 1995) discloses a sliding hooded mail carrier tray that is slidably inserted into a mailbox. The upper rails of the hooded mail carrier and lower rails of the mailbox are of a channel-shaped configuration. The upper rails are attached to the hooded mail carrier at opposite sides thereof, leaving the channels opening outwardly in a direction away from one another. The lower rails are attached to the mailbox at opposite sides thereof, leaving the channels opening inwardly in a direction towards one another. The upper rollers are mounted on an interior surface of the mailbox, and the lower rollers are mounted on an exterior surface of the hooded mail carrier. The upper rollers of the mailbox engage with the upper channel-shaped rails of the hooded mail carrier, and the lower rollers of the hooded mail carrier engage with the lower channel-shaped rails of the mailbox in sliding horizontal engagement together.

U.S. Pat. No. 6,698,651 (Green, 2004) provides a slidable tray mailbox insert comprised of a tray and a track assembly. The track assembly comprises a track frame attached to the bottom of the mailbox and a pair of track members on the bottom of the tray. Two extension arms are pivotally attached to the sidewalls of the tray and attached to the inside of the mailbox door. The extension arms pulls the tray forward on the track frame when the door is opened until stop members on the frame and tray half its forward movement.

U.S. Pat. No. 6,997,373 (Flores, 2006) is another invention in which a sliding tray is disposed within the mailbox on a pair of tracks. The tracks are telescopic, ball bearing tracks that glide along each other to dispose the tray completely outside of the housing. Each track comprises three telescoping slides. The tray is attached to the door so that the door may be opened without pulling the tray forward or opened while pulling the tray forward at the same time.

U.S. Pat. No. 7,004,380 (Gunvaldson. 2006) discloses a guided mailbox tray that is pivotally attached to the inside of the mailbox door via a bracket and a runner on either side of the tray that travels forward and rearward along the tray within a slot in the side wall of the tray. The tray is extended and retracted when the mailbox door is opened and closed.

U.S. Pat. No. 8,042,729 (Dinh, 2011) provides a mailbox tray disposed within the interior of the mailbox and pivotally attached to the inside of the mailbox door. The tray moves forward and rearward within the mailbox on rollers that are situated within tracks on the mailbox floor. In one embodiment, the slidable tray is articulated and comprises front and rear segments that are pivotally attached to each other and operably connected to first and second sliding means, respectively. The rear end of the rear segment tilts progressively upward as the front door is pulled open until the rear segment is at a 45-degree angle relative to the mailbox floor. The first sliding means is parallel to the mailbox floor, and the second sliding means is aligned at an angle to the first sliding means. The second sliding means is a tilt track and roller combination in which a tilt track is mounted on each sidewall at an angle. When the mailbox door is closed, the rear segment returns to an orientation substantially coplanar with the front segment.

U.S. Pat. No. 8,657,185 (Corey, 2014) discloses a movable mailbox tray that is mounted within the mailbox and attached to the mailbox door. The tray is repositioned both horizontally and vertically in the direction of the user when the mailbox door is opened. When the door is opened, the tray is declined so that the front end of the tray is lower than the mailbox floor. When the door is closed, the tray is inclined so that the front end of the tray is higher than the rear end of the tray, which rests on the mailbox floor.

BRIEF SUMMARY OF THE INVENTION

The present invention is a mailbox comprising: a mailbox housing; a mailbox floor; a mail receptacle having two side walls, a rear wall, and a floor; and a front door; wherein the mail receptacle is situated on top of a sliding rail assembly affixed to the mailbox floor; wherein a first bracket is attached to a center of an inside surface of the front door and oriented so that it extends from a top part of the front door to a bottom part of the front door; wherein the first bracket is connected to a first U-shaped bracket that is attached to the inside surface of the front door, the first U-shaped bracket having an open part and a lateral part, and the first U-shaped bracket being oriented so that the open part of the U-shaped bracket faces downwardly; wherein the first U-shaped bracket further comprises two legs, each having a bottom end; wherein the bottom end of each of the two legs of the first U-shaped bracket is pivotally attached to a proximal end of a longitudinal rod that extends underneath the mailbox front a front of the mailbox to a point beyond a rear end of the mailbox housing; wherein a distal end of each longitudinal rod is attached to a second U-shaped bracket comprising an open part and a lateral part, the open part of the second U-shaped bracket facing downwardly; wherein the second U-shaped bracket further comprises two legs, each having a bottom end; wherein the bottom end of each of the two legs of the second U-shaped bracket is pivotally attached to the distal end of one of the two longitudinal rods; wherein the lateral part of the second U-shaped bracket is attached to a rear end of the mailbox floor; wherein a first end of a traveling rod is attached to and extends upwardly from the lateral part of the second U-shaped bracket; wherein a second end of the traveling rod is attached to a shaft; wherein a wheel bearing is situated on either end of the shaft; and wherein a receiving bracket is attached to an outside surface of the rear wall of the mail receptacle and is configured to receive the wheel bearings and shaft.

In a preferred embodiment, each of the side walls of the mail receptacle has a front portion with a bottom edge that is angled upward at a certain angle, and the floor of the mail receptacle has a front section that is angled upward to match the certain angle of the front portions of the side walls. In a preferred embodiment, the rear wall of the mail receptacle comprises a top part with two beveled edges on either side of the top part to enable the mail receptacle to fit within the mailbox housing. The mail receptacle is not connected in any manner to the front door of the mailbox.

REFERENCE NUMBERS

Figure 1:
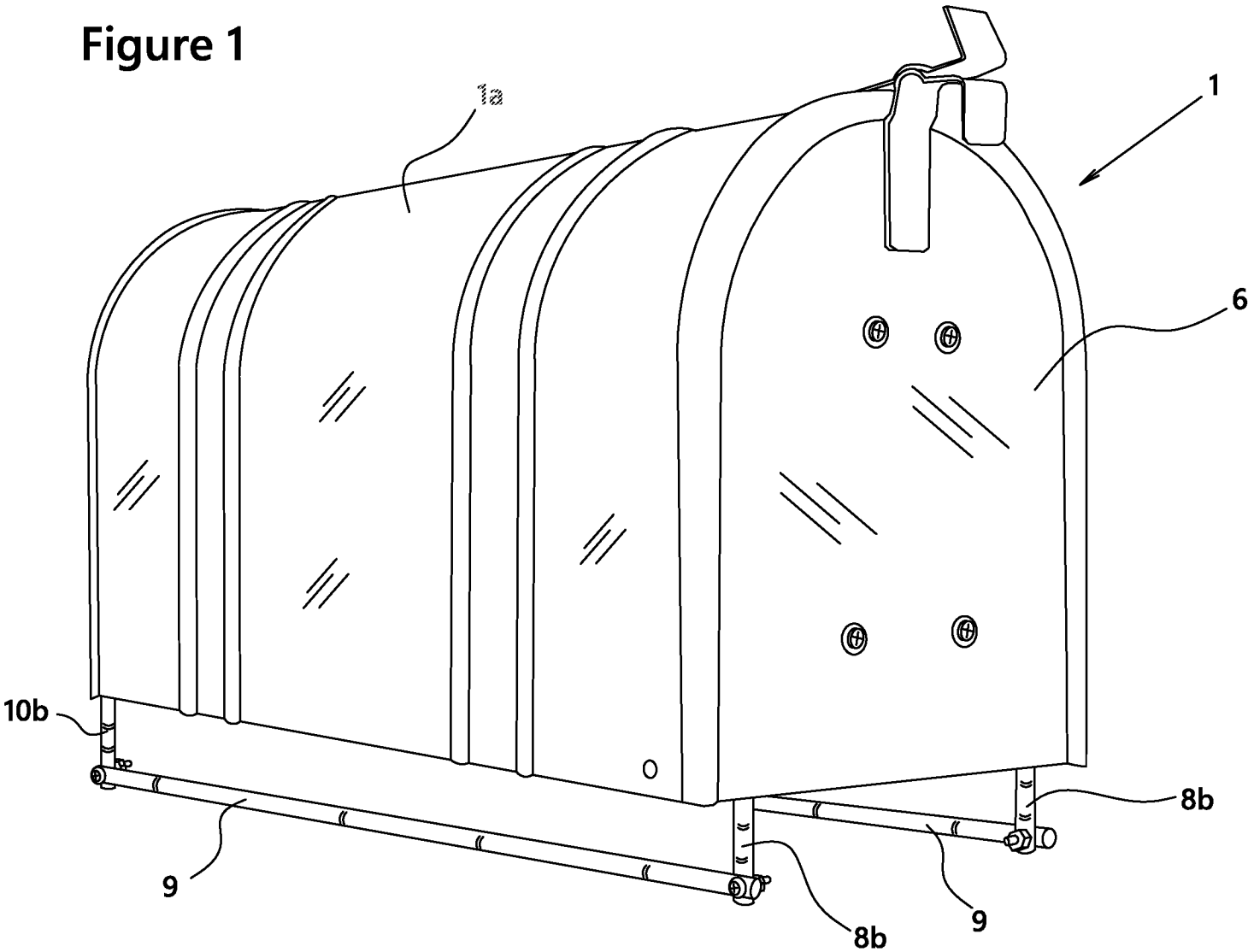
FIG. 1 is a front perspective view of the present invention shown with the mailbox in a closed position.

1 Mailbox
1*a* Mailbox housing
1*b* Mailbox floor
2 Mail receptacle
3 Side walls (of mail receptacle)
3*a* Bottom edge (of side wall)
4 Rear wall (of mail receptacle)
4*a* Beveled edge (of rear wall)
5 Floor (of mail receptacle)
5*a* Front section (of floor)
6 Front door (of mailbox)
7 First bracket
8 First U-shaped bracket
8*a* Lateral part (of first U-shaped bracket)
8*b* Legs (of first U-shaped bracket)
9 Longitudinal rods
10 Second U-shaped bracket
10*a* Lateral part (of second U-shaped bracket)
10*b* Legs (of second U-shaped bracket)
11 Traveling rod
12 Shaft
13 Wheel bearings
14 Receiving bracket
14*a* Channels (in receiving bracket)
14*b* Open center part (of receiving bracket)

14*c* Lips (of receiving bracket)
15 Sliding rail assembly

DETAILED DESCRIPTION OF INVENTION

Figure 2:
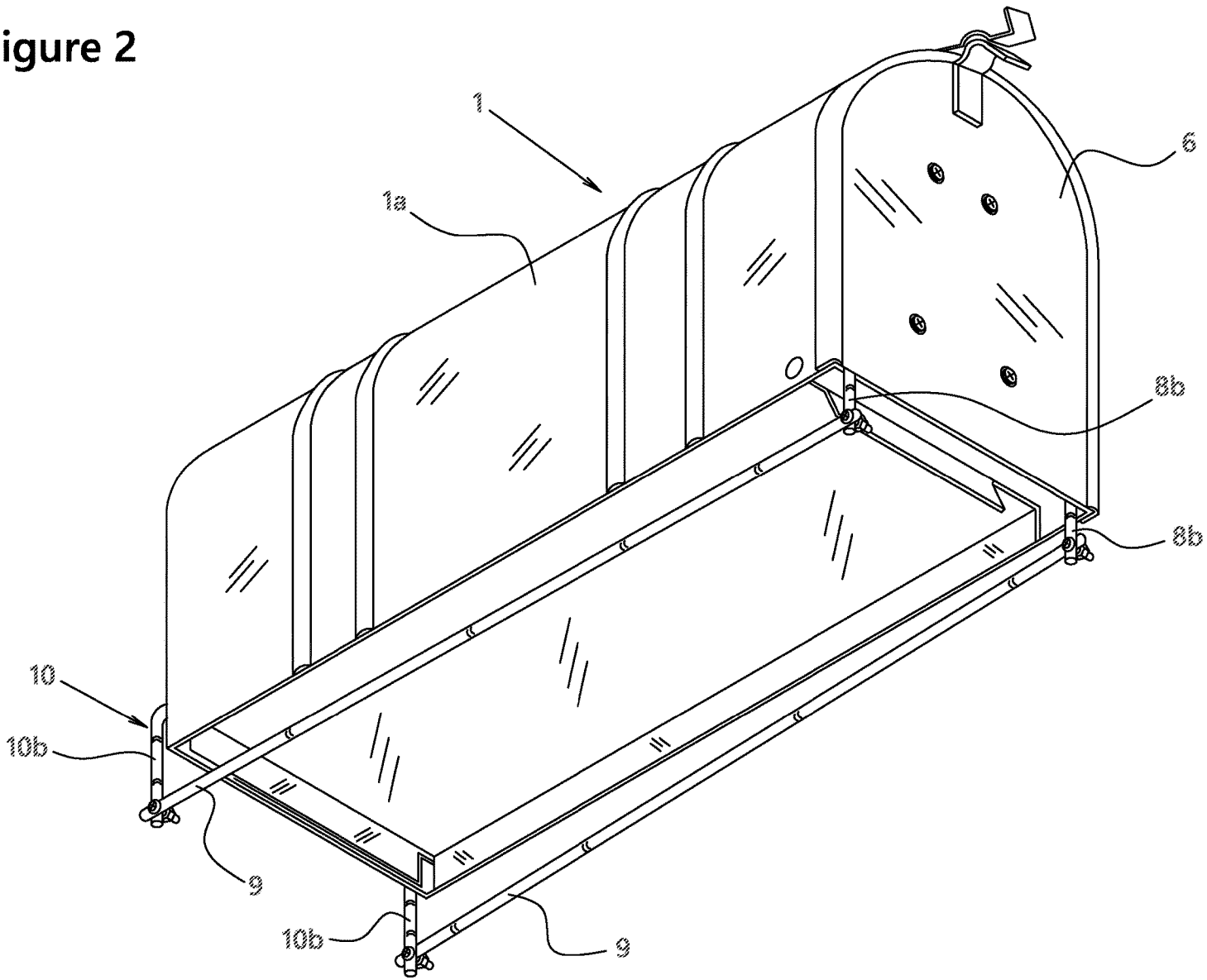
FIG. 2 is a bottom perspective view of the present invention shown with the mailbox in a closed position.
Figure 3:
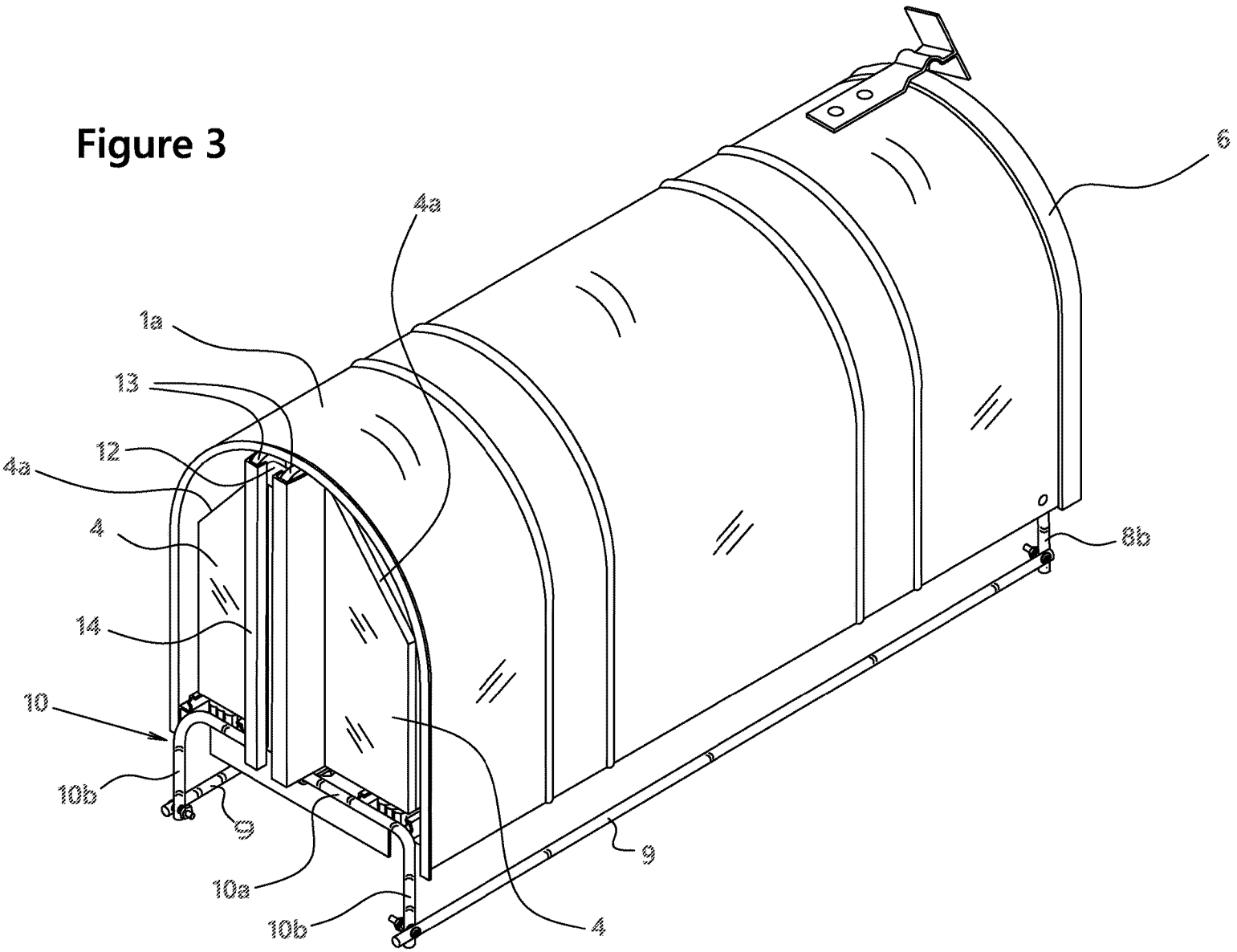
FIG. 3 is a rear perspective view of the present invention shown with the mailbox in a closed position.
Figure 4:
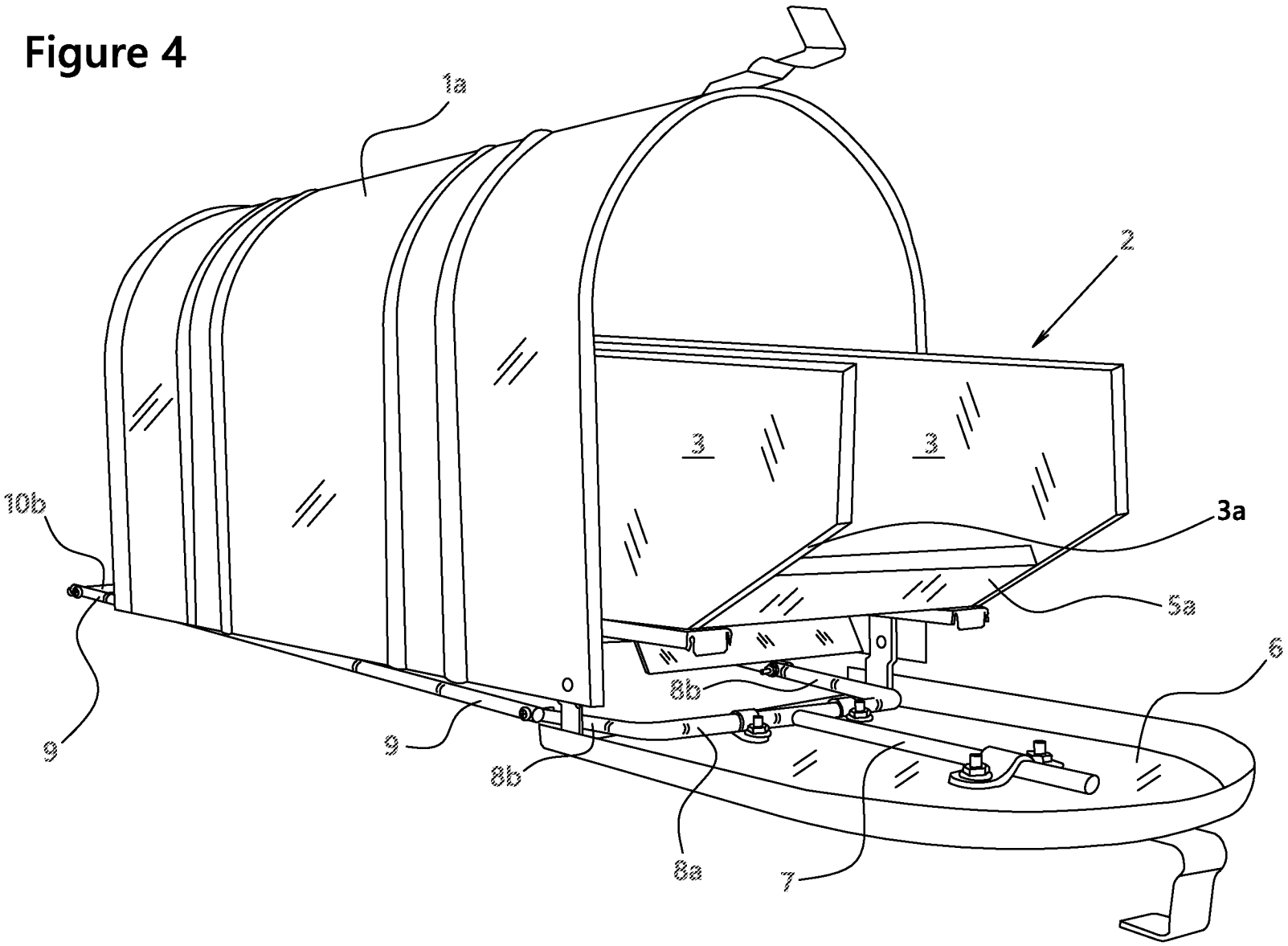
FIG. 4 is a front perspective view of the present invention shown with the mailbox in an open position.
Figure 5:
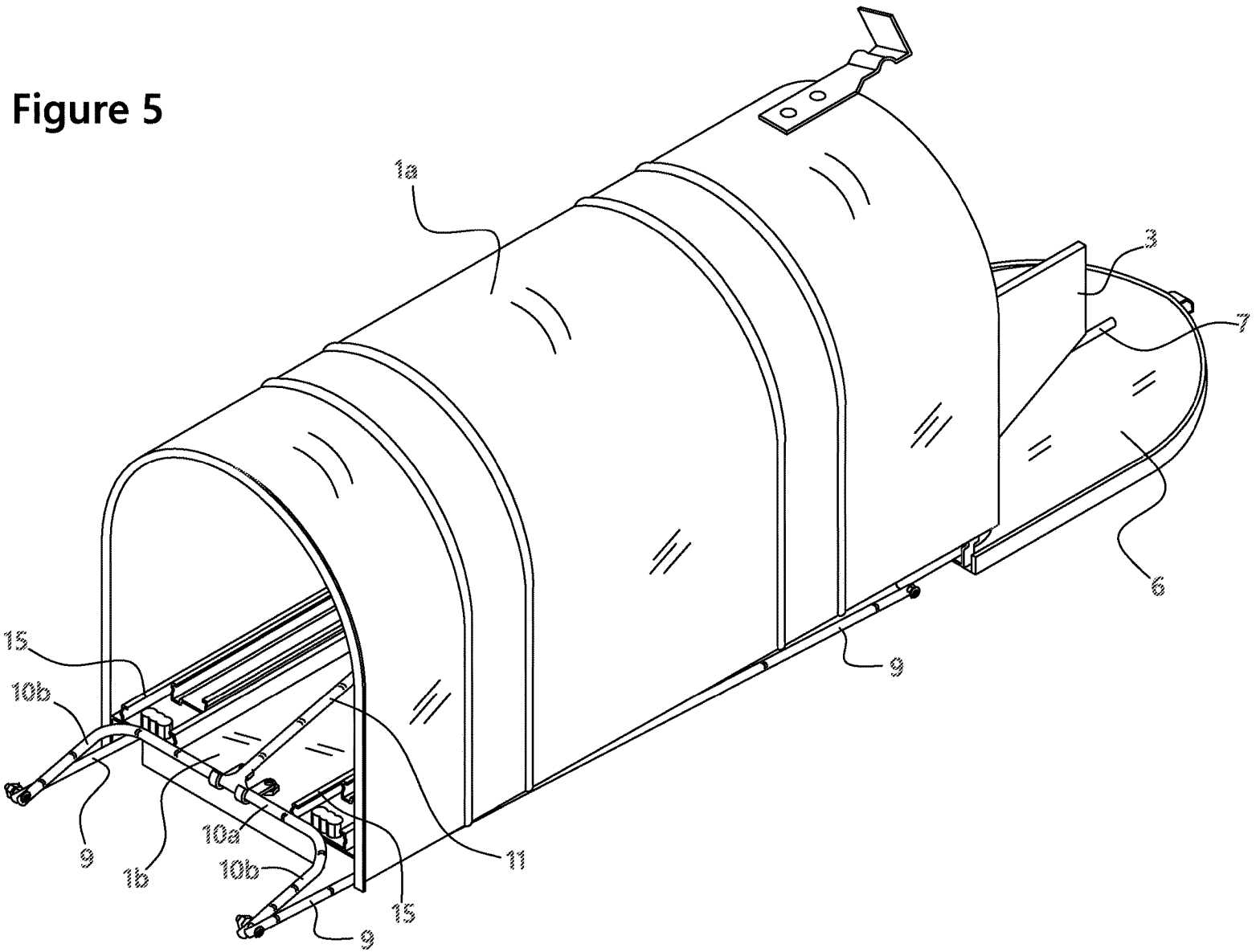
FIG. 5 is a rear perspective view of the present invention shown with the mailbox in an open position.
Figure 6:
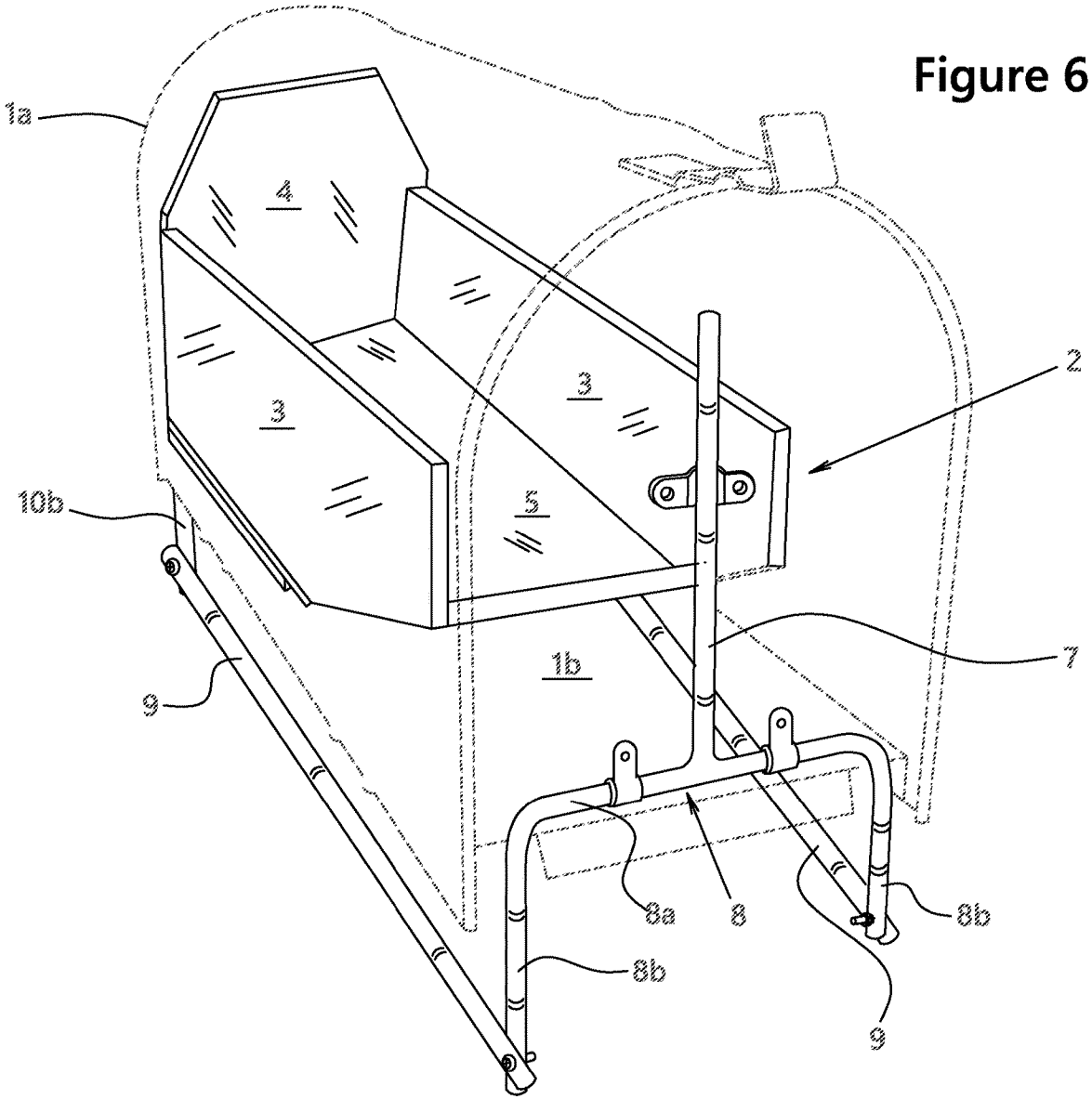
FIG. 6 is a phantom front perspective view of the present invention shown with the mailbox in a closed position.
Figure 7:
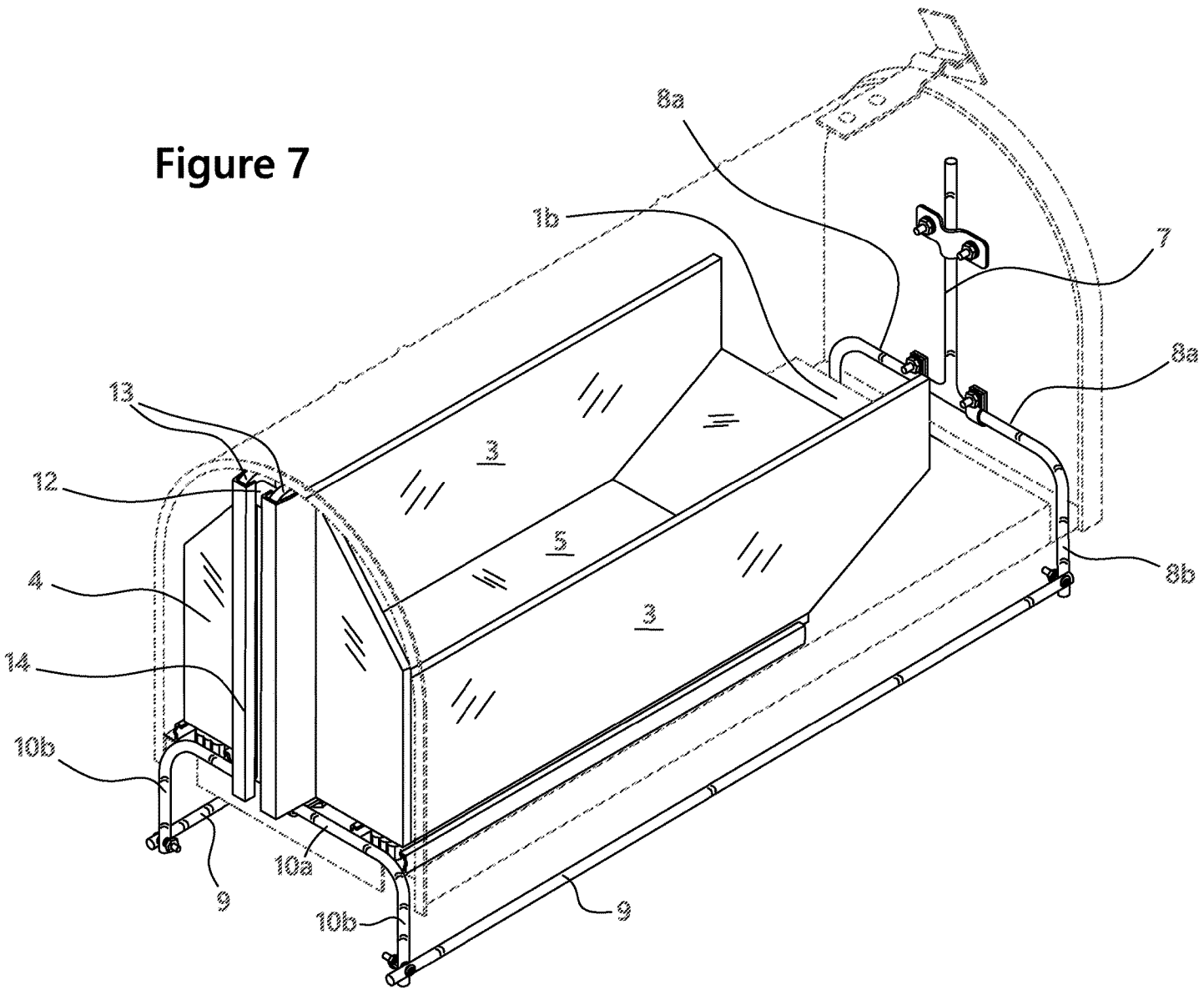
FIG. 7 is a phantom rear perspective view of the present invention shown with the mailbox in a closed position.
Figure 8:
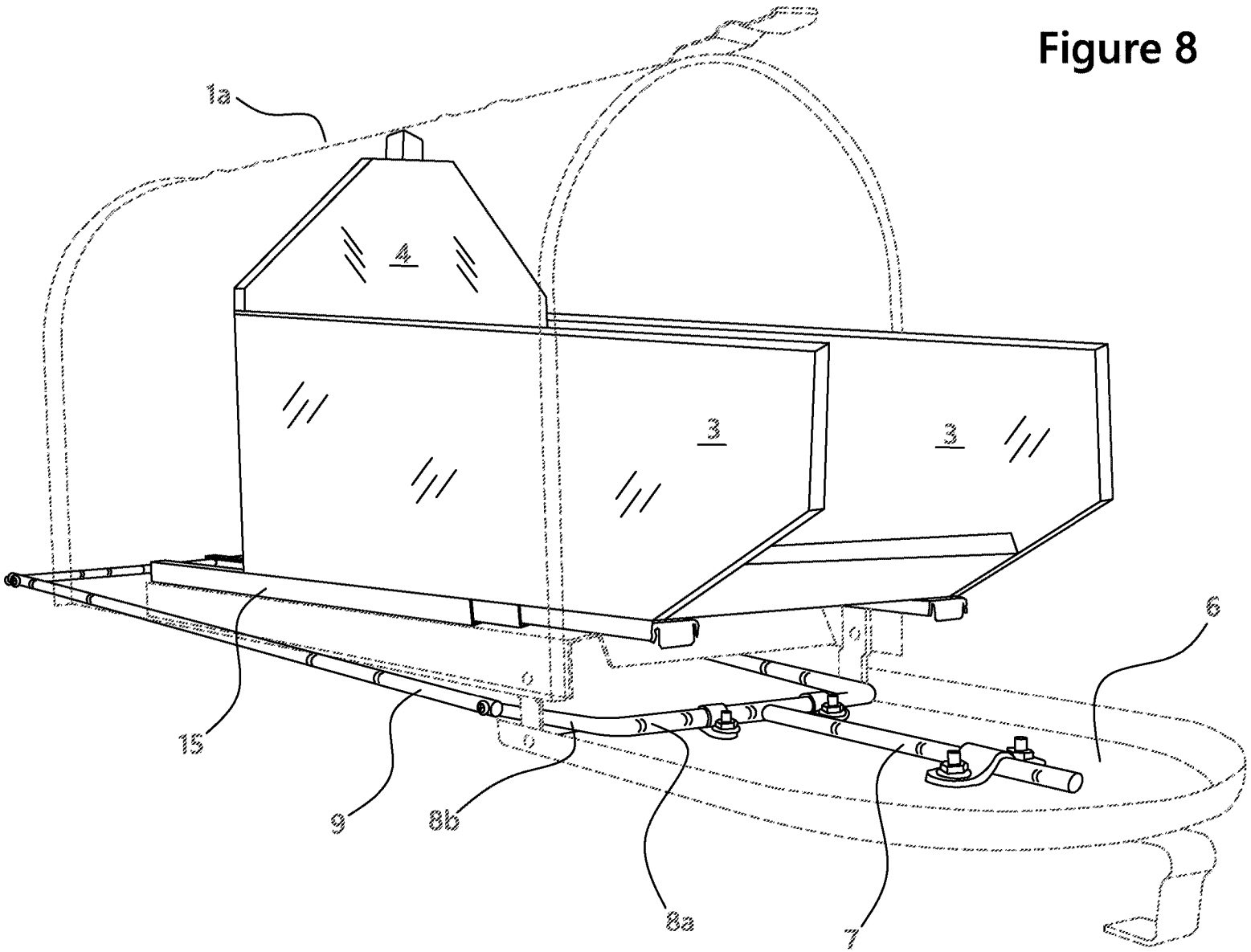
FIG. 8 is a phantom front perspective view of the present invention shown with the mailbox in an open position.

FIGS. 1, 2 and 3 are perspective views of the present invention with the mailbox shown in a closed position, and FIGS. 4 and 5 are perspective views of the present invention shown in an open position. As shown in these figures, the invention is comprised of a mailbox 1 with a mailbox housing 1*a* and a mailbox floor 1*b*. The invention further comprises a mail receptable 2 with two sides walls 3, a rear wall 4, and a floor 5. The floor 5 preferably comprises a front section 5*a* that is tilted upward at an angle that matches the angle of the bottom edge 3*a* of the front portion of each side wall 3. Note that the rear wall 4 of the receptacle 2 preferably comprises two beveled edges 4*a* on either side of the top part of the rear wall 4 to enable the receptable to fit within the mailbox housing 1*a*. It is important to note that the receptacle 3 is not connected to the front door 6 of the mailbox.

Figure 13:
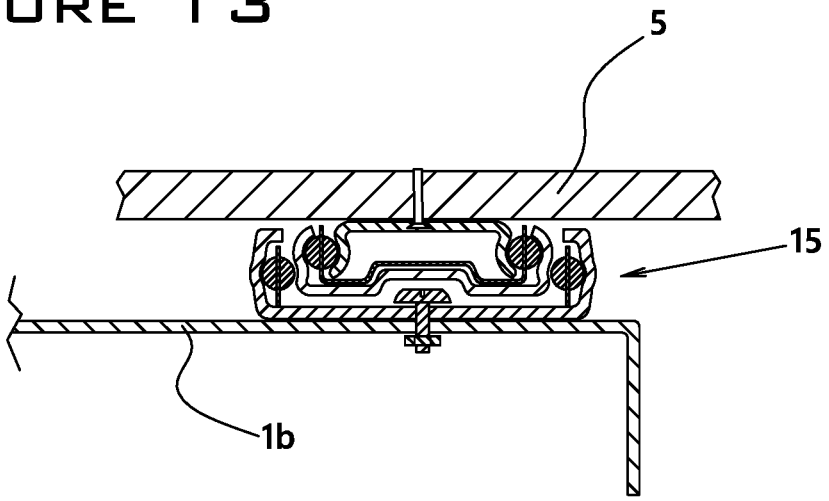
FIG. 13 is a detail cross-section view of the sliding rail assembly of the present invention taken at the line shown in FIG. 11.
Figure 14:
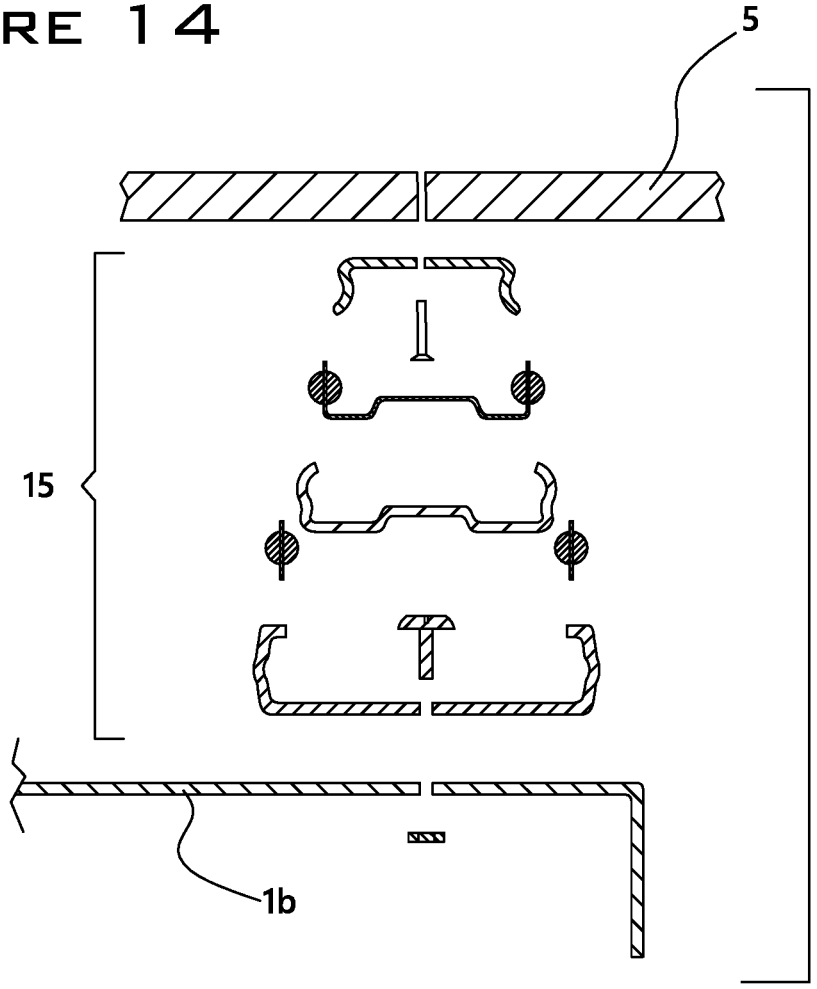
FIG. 14 is an exploded view of the sliding rail assembly of the present invention.

The receptacle 3 lies on top of a sliding rail assembly, which is shown in detail in FIGS. 13 and 14. A first bracket 7 is attached to the center of the inside surface of the front door 6 and is oriented so that it extends from a top part of the front door to a bottom part of the front door. At the bottom part of the front door, this bracket 7 connects to a first U-shaped bracket 8 that is also attached to the inside surface of the front door 6. The first U-shaped bracket 8 is oriented so that the open part of the "U" faces downwardly, the lateral part 8*a* of the "U" is situated just above the mailbox floor 1*b*, and the two legs of the "U" 8*b* extend beyond the bottom edge 6*a* of the front door 6 (so that they are lower than the mailbox floor 1*b*). The bottom end of each of the legs 8*a* is rotatably attached to a longitudinal rod 9 that extends underneath the mailbox 1 from the front of the mailbox to a point beyond the rear end of the mailbox housing 1*a*.

Figure 15:
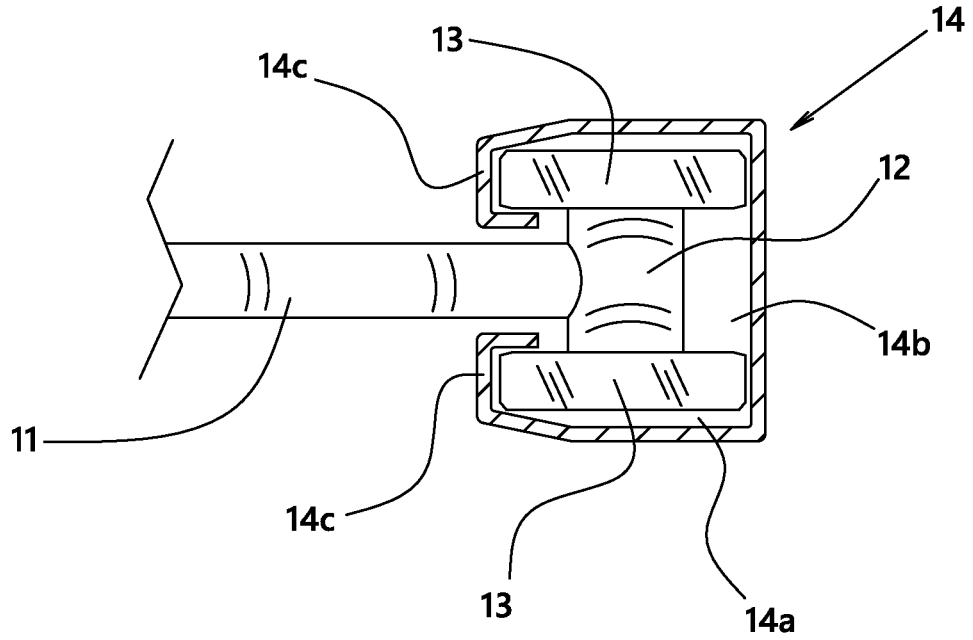
FIG. 15 is a detail view of the distal end of the traveling rod of the present invention.

The distal (or rear) end of each longitudinal rod 9 is attached to a second U-shaped bracket 10 that is also oriented so that the open part of the "U" faces downwardly, and each of the legs 10*b* is attached at its distal end to the distal (or rear) end of one of the longitudinal rods 9. The lateral part 10*a* of the second U-shaped bracket 10 is situated slightly above the level of the mailbox floor 1*b*, and the legs 10*b* are situated entirely beneath (or below) the level of the mailbox floor 1*b*. A traveling rod 11 is attached to and extends upwardly from the center of the lateral part 10*a* of the second U-shaped bracket 10. The first end of the traveling rod 11 is attached to the second U-shaped bracket 10, and the second end of the traveling rod 11 is attached to a shaft 12. On either side of the shaft 12 are wheel bearings 13 (see FIG. 15 for additional detail).

A receiving bracket 14 is attached to the outside surface of the rear wall 4 of the receptacle 2 and is configured to receive the wheel bearings 13 and shaft 12. The receiving bracket 14 comprises right and left channels 14*a* in which the wheel bearings 13 travel up and down as the shaft 12 is moved upward and downward within the open center part 14*b* of the receiving bracket 14. When the mailbox is fully closed, the traveling rod 11 is in a vertical position, and the entire length of the traveling rod 11 is situated within the open center part of the receiving bracket 14. The channels 14*a* in the receiving bracket 14 are formed by lips 14*c* that extend inwardly from each side of the receiving bracket 14.

Figure 9:
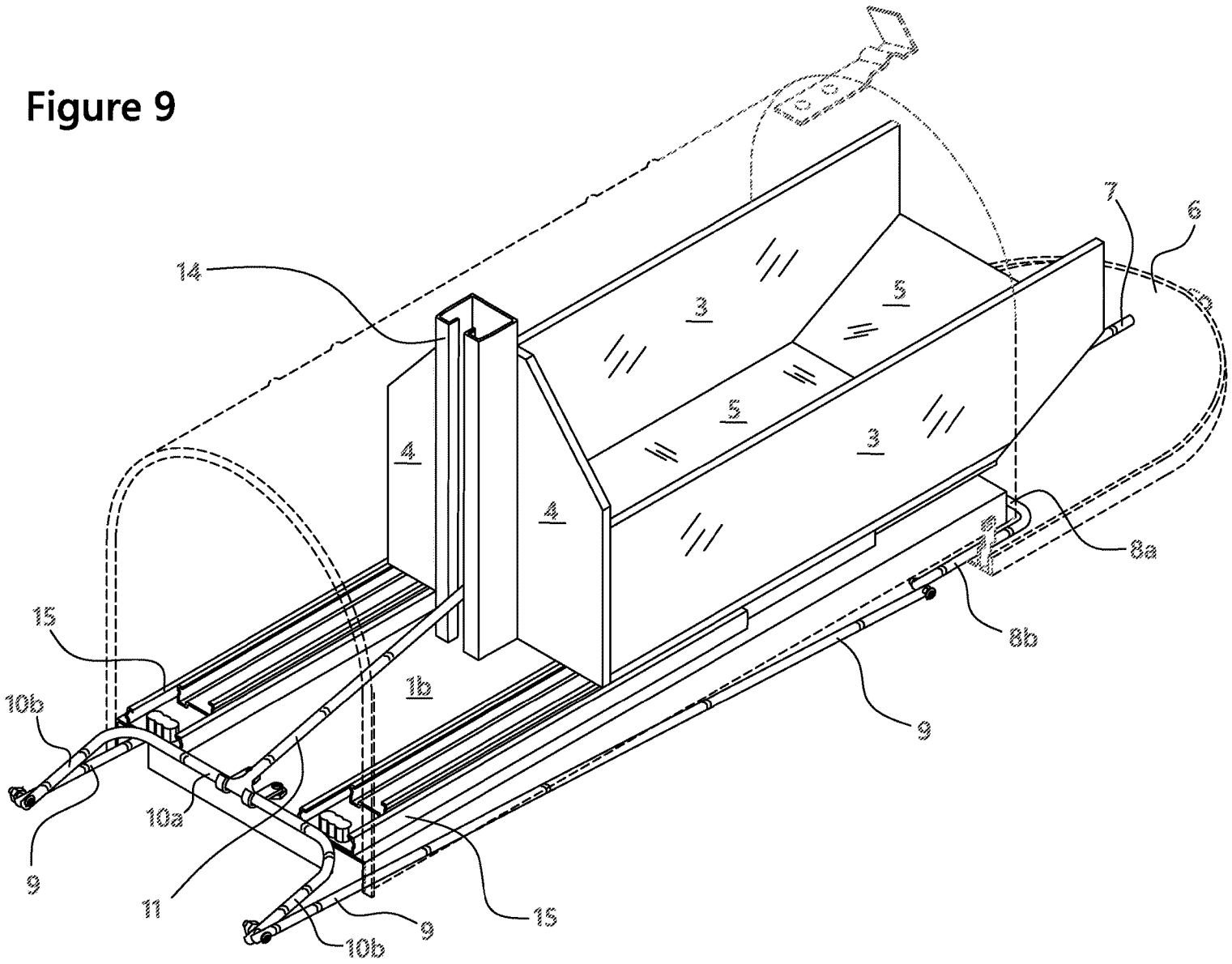
FIG. 9 is a phantom rear perspective view of the present invention shown with the mailbox in an open position.
Figure 16:
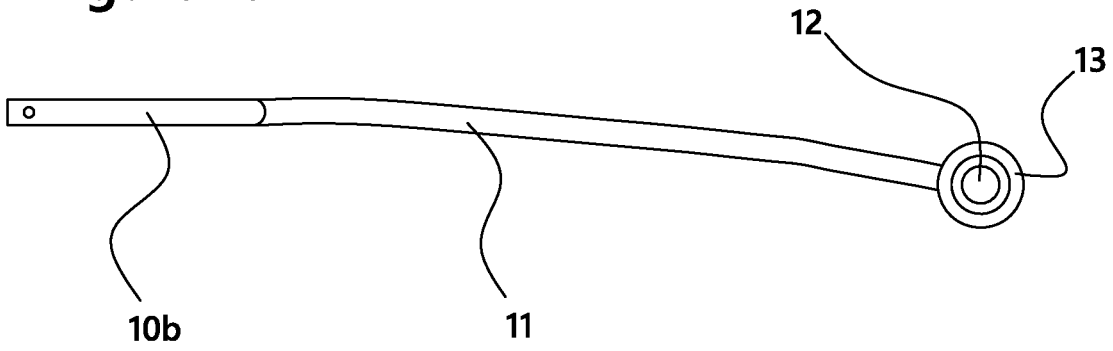
FIG. 16 is a side view of an alternate embodiment of the traveling rod.

When the mailbox door 6 is opened manually by a user, by virtue of the mechanical connections discussed above, the distal ends of the legs 8*a* push the longitudinal rods 9 rearward. When the longitudinal rods 9 are pushed rearward, the second U-shaped bracket 10 rotates into the position shown in FIG. 5, with the legs 10*b* tilted in a rearward direction, as shown. As the second U-shaped bracket 10 is rotated, the traveling rod 11 is pushed forward, and the shaft 12 travels to the bottom of the open center part 14*b* of the receiving bracket 14. The traveling rod 11 may be straight, as shown in FIG. 9, or it may be slightly bent to provide additional leverage, as shown in FIG. 16.

As the shaft 12 travels to the bottom of the open center part 14*b* of the receiving bracket 14, the traveling rod 11 pushes the receptacle 2 forward, thereby causing the front part of the receptable 2 to extend past the front edge of the mailbox housing 1*a*, as shown in FIG. 4. In this manner, the receptable is pushed—not pulled—out of the mailbox. This structural feature distinguishes the present invention from prior art. When the front door 6 of the mailbox is closed by the user, the second U-shaped member 10 rotates back into the position shown in FIG. 3, and the legs 10*b* push the longitudinal rods 9 forward. At the same time, the shaft 12 returns to its position at the top of the open center part 14*b* of the receiving bracket 14, and the wheel bearings 13 return to the top of the channels 14*a*. The force exerted by the user to close the front door 6 causes the second U-shaped bracket 10 to rotate, the shaft 12 to travel upwardly within the open center part 14*b* of the receiving bracket 14, and the receptacle 2 to move rearwardly on the sliding rail assembly 15 so that it is fully enclosed within the mailbox housing 1*a*.

Figure 10:
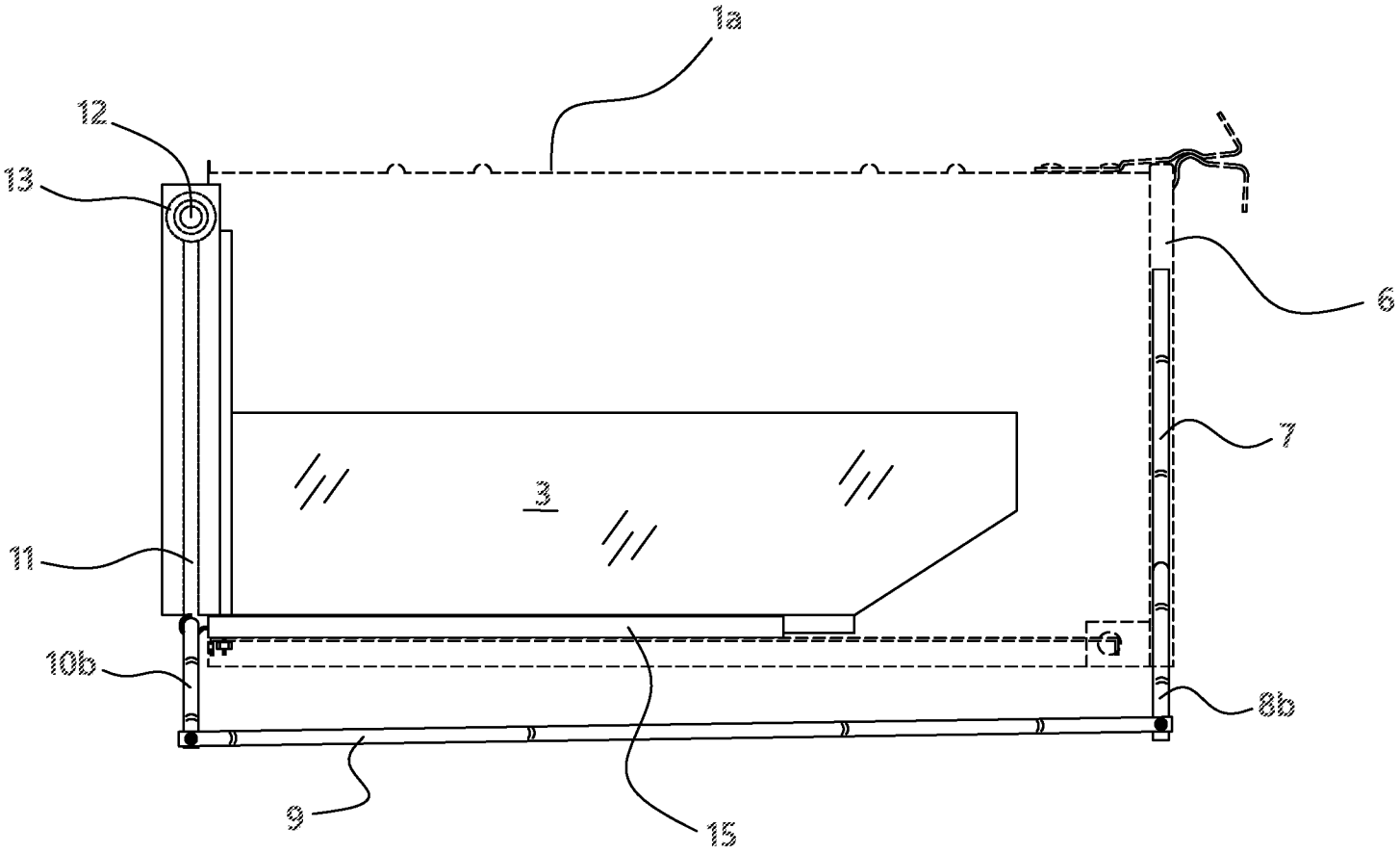
FIG. 10 is a side view of the present invention shown with the mailbox in a closed position.
Figure 11:
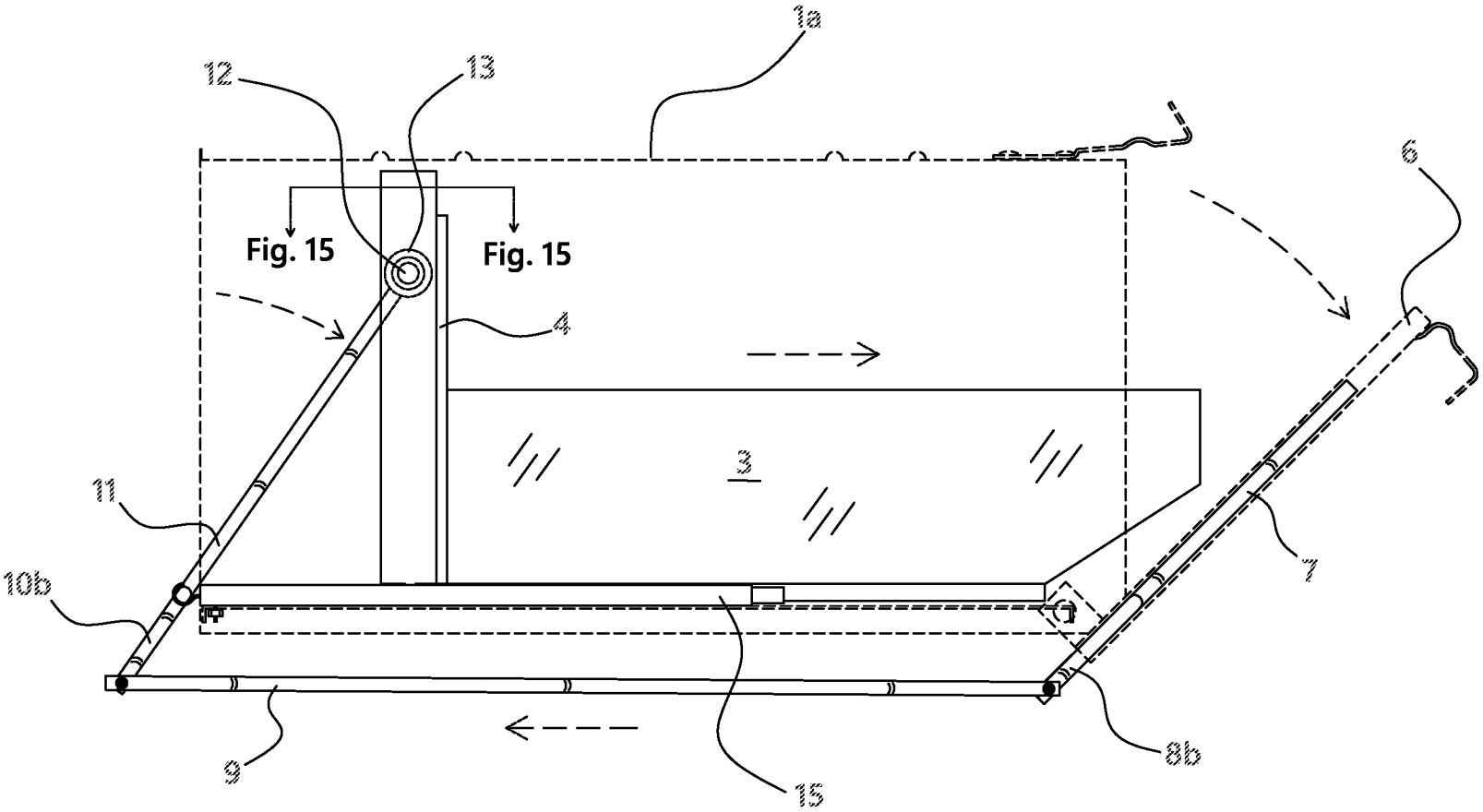
FIG. 11 is a side view of the present invention shown with the mailbox in a partially open position.
Figure 12:
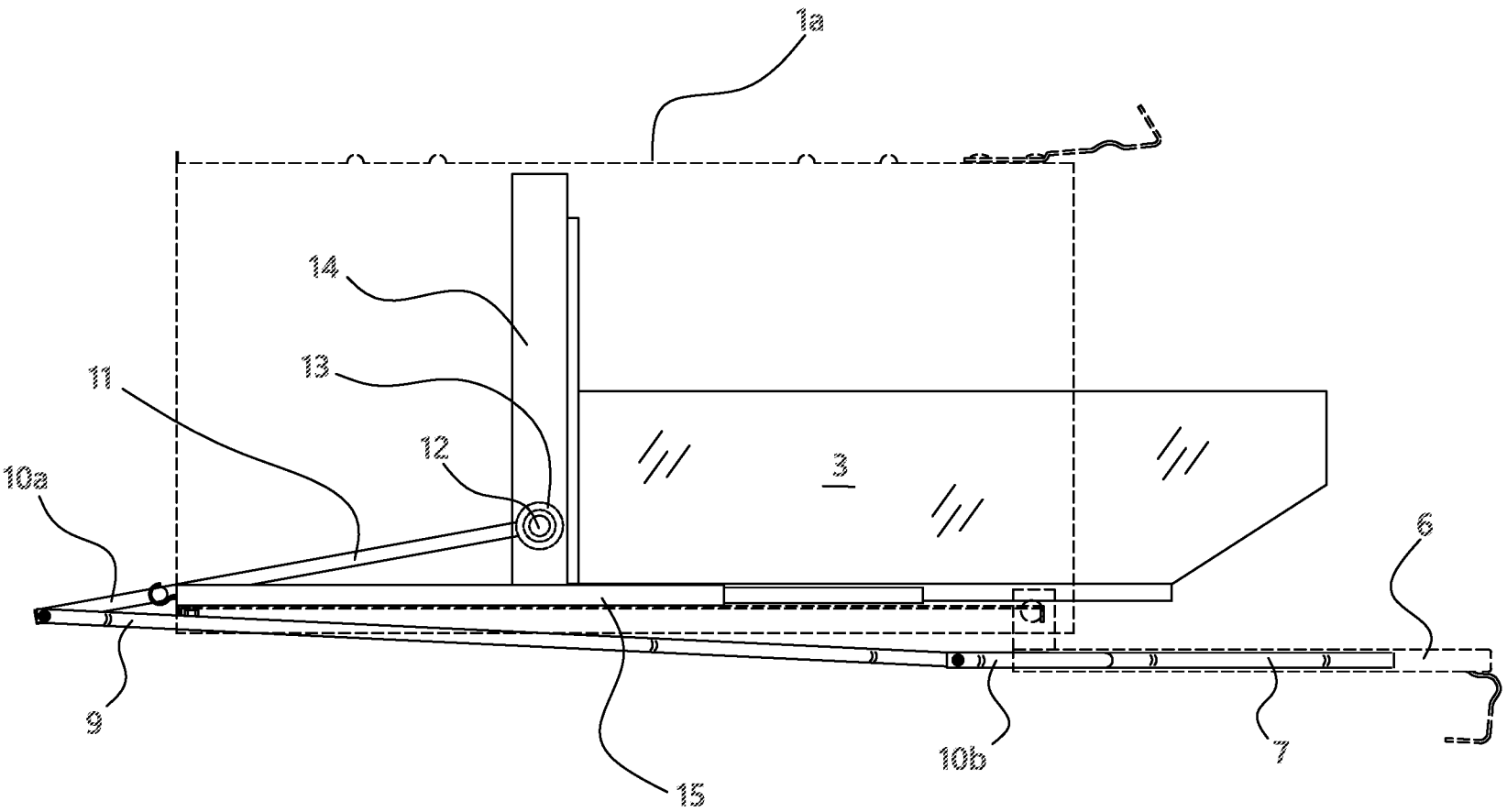
FIG. 12 is a side view of the present invention shown with the mailbox in a fully open position.

FIGS. 6-9 are phantom views of the present invention that provide clearer views of the interior workings of the mailbox. FIG. 10 is a phantom side view of the mailbox in a closed position. FIGS. 11 and 12 are phantom side views of the mailbox shown in a partially open and a fully open position, respectively. As shown in FIGS. 10-12, by virtue of the relative placement of the first U-shaped bracket 8 and second U-shaped bracket 10, the longitudinal rods 9 are slightly higher in the front than in the back when the mailbox is in a closed position, horizontal when the mailbox is in a partially open position (when the door is inclined at a 45-degree angle), and lower in the front than in the back when the mailbox is in a fully open position. Specifically, the lateral part 8*a* of the first U-shaped member is on a slightly higher horizontal plane (in other words, it is slightly higher relative to the mailbox floor 1*b*) than the lateral part 10*a* of the second U-shaped member 10 when the mailbox is in a closed position. When the mailbox is in the partially open position shown in FIG. 11, the lateral parts 8*a* and 10*a* are on the same horizontal plane.

FIG. 13 is a cross-section view of the sliding rail assembly of the present invention taken at the line shown in FIG. 11. FIG. 14 is an exploded view of the sliding rail assembly. As shown in these figures, the sliding rail assembly 15 is comprised of three telescoping tracks that are slidably engaged via ball bearings. A typical example of this kind of sliding rail assembly is the Everbilt® Ball Bearing Slide Set manufactured and distributed by Home Depot Product Authority, LLC of Atlanta, Ga.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A mailbox comprising:

(a) a mailbox housing;

(b) a mailbox floor;

(c) a mail receptacle having two side walls, a rear wall, and a floor; and (d) a front door;

wherein the mail receptacle is situated on top of a sliding rail assembly affixed to the mailbox floor;

wherein a first bracket is attached to a center of an inside surface of the front door and oriented so that it extends from a top part of the front door to a bottom part of the front door;

wherein the first bracket is connected to a first U-shaped bracket that is attached to the inside surface of the front door, the first U-shaped bracket having an open part and a lateral part, and the first U-shaped bracket being oriented so that the open part of the U-shaped bracket faces downwardly;

wherein the first U-shaped bracket further comprises two legs, each having a bottom end;

wherein the bottom end of each of the two legs of the first U-shaped bracket is pivotally attached to a proximal end of a longitudinal rod that extends underneath the mailbox from a front of the mailbox to a point beyond a rear end of the mailbox housing;

wherein a distal end of each longitudinal rod is attached to a second U-shaped bracket comprising an open part and a lateral part, the open part of the second U-shaped bracket facing downwardly;

wherein the second U-shaped bracket further comprises two legs, each having a bottom end;

wherein the bottom end of each of the two legs of the second U-shaped bracket is pivotally attached to the distal end of one of the two longitudinal rods;

wherein the lateral part of the second U-shaped bracket is attached to a rear end of the mailbox floor;

wherein a first end of a traveling rod is attached to and extends upwardly from the lateral part of the second U-shaped bracket;

wherein a second end of the traveling rod is attached to a shaft;

wherein a wheel bearing is situated on either end of the shaft; and wherein a receiving bracket is attached to an outside surface of the rear wall of the mail receptacle and is configured to receive the wheel bearings and shaft.

2. The mailbox of claim 1, wherein each of the side walls of the mail receptacle has a front portion with a bottom edge that is angled upward at a certain angle; and wherein the floor of the mail receptacle has a front section that is angled upward to match the certain angle of the front portions of the side walls.

3. The mailbox of claim 1, wherein the rear wall of the mail receptacle comprises a top part with two beveled edges on either side of the top part to enable the mail receptacle to fit within the mailbox housing.

4. The mailbox of claim 1, wherein the wherein the mail receptacle is not connected in any manner to the front door of the mailbox.

* * * * *